United States Patent [19]

Johnson et al.

[11] 3,977,639

[45] Aug. 31, 1976

[54] FREE FALL SAFETY ASSEMBLY FOR USE WITH A LUMINAIRE RAISE-LOWER APPARATUS

[75] Inventors: Brady Glenn Johnson; Robert Dale Zeller, both of Newark, Ohio

[73] Assignee: Johns-Manville Corporation, Denver, Colo.

[22] Filed: June 16, 1975

[21] Appl. No.: 587,444

[52] U.S. Cl. ..... 248/125; 240/88; 240/64

[51] Int. Cl.[2] ..... A47G 29/00

[58] Field of Search ..... 248/125; 240/64, 88, 240/67, 68; 254/184, 173 R

[56] References Cited

UNITED STATES PATENTS

| | | | |
|---|---|---|---|
| 3,265,360 | 8/1966 | Tax | 254/184 |
| 3,608,864 | 9/1971 | Dargitz | 254/173 |
| 3,673,403 | 6/1972 | Woods | 240/64 |
| 3,686,498 | 8/1972 | Meyer | 240/88 |
| 3,759,489 | 9/1973 | Jones | 254/173 |
| 3,840,212 | 10/1974 | Latanision | 240/88 |
| 3,847,333 | 11/1974 | Zeller | 248/125 |
| 3,856,639 | 12/1974 | Rohn et al. | 240/64 |

*Primary Examiner*—Robert A. Hafer

*Attorney, Agent, or Firm*—Robert M. Krone; Joseph J. Kelly; Stephen C. Shear

[57] ABSTRACT

An auxiliary assembly for use with an apparatus which raises and lowers a luminaire support ring along a support pole and which supports the ring during this movement is disclosed herein. The apparatus includes a main drive, a main cable connected to the drive and a plurality of secondary cables connecting the main cable and therefore the main drive to the luminaire support ring. The auxiliary assembly includes an auxiliary supporting arrangement connected with the main cable of the apparatus whereby to support the ring in the event there is a failure of either the main cable or the main drive to support the ring. This assembly also includes a device for automatically and substantially immediately sensing the presence of such a failure and for automatically providing a predetermined signal at substantially the moment of failure. In addition, the assembly includes a device which cooperates with the auxiliary supporting arrangement for at least slowing down, preferably stopping, movement of the luminaire support ring in response to the failure indicating signal.

14 Claims, 4 Drawing Figures

FREE FALL SAFETY ASSEMBLY FOR USE WITH A LUMINAIRE RAISE-LOWER APPARATUS

BACKGROUND OF THE INVENTION

The present invention relates generally to an apparatus for raising and lowering a luminaire support ring along a support pole and more particularly to an auxiliary safety assembly for use with such an apparatus.

In highway and field lighting, it is not unusual to have one or more luminaires mounted as high as 50 to 150 feet from the ground. These luminaires are generally mounted to the top of a suitable support pole. In the past, these luminaires were repaired or otherwise maintained in place, i.e., at the top of the pole. This required suitable means to reach the luminaires and was time consuming, inconvenient and obviously relatively expensive. More recently, in order to avoid these drawbacks, it has been the practice of some manufacturers to provide a high mount luminaire apparatus or system including a luminaire support mounted for movement along the pole. In this manner, when the luminaire or luminaires required maintenance work, the entire support could be moved down to the ground and after the work was completed it could be moved back up to the top of the pole.

A typical system of the type just described includes a luminaire support, typically a ring positioned around the luminaire pole and having one or more luminaires supported therefrom, and some type of latching mechanism at the top of the pole to hold the ring in place. An arrangement of cables connect the luminaire support ring to a winch assembly located at ground level for raising and lowering the support. Where the winch assembly is power driven, power actuated drive means can be provided in place at each winch assembly or a single portable drive can be provided and is typically electrically actuated using the same electrical source as that of the luminaires. This system clearly avoids the aforediscussed maintenance drawbacks associated with luminaires that are fixed at the top of their associated poles and not movable to ground level. However, this movable system does introduce a different problem, i.e., the possibility of failure of the winch assembly and/or the cable arrangement to support the luminaire support ring during its movement up or down the pole, causing the support to fall to the ground. As will be seen hereinafter, the present invention while not minimizing the possibility of such a failure (which itself is not likely) does minimize the possibility that the luminaire support will fall to the ground due to such failure.

BRIEF SUMMARY OF THE INVENTION

An object of the present invention is to provide an auxiliary assembly for use with a luminaire support raise-lower system of the type just described, which assembly minimizes the possibility that the luminaire support will fall freely by its own weight to the ground in the event of a failure in the raise-lower system to support the luminaire support.

Another object of the present invention is to provide an auxiliary assembly which cooperates with a segment of the cable arrangement comprising part of the raise-lower system for raising and lowering the luminaire support.

Still another object of the present invention is to provide an uncomplicated, economical and portable auxiliary assembly of the type described above.

As stated previously, a typical system or apparatus for raising and lowering a luminaire support along a support pole includes a main drive assembly, for example a power actuated winch, and main cable means, for example a single main cable connected to the power winch and a plurality of secondary cables connecting the main cable to the luminaire support. In accordance with the present invention, Applicants' auxiliary assembly includes an auxiliary supporting arrangement which itself includes auxiliary cable means, auxiliary cable support means and means for maintaining the auxiliary cable means taut. The auxiliary cable means, preferably a single cable, is connected with the main cable means of the apparatus at a fixed point between the luminaire support and the main drive means, preferably at the point of connection between the main cable and secondary cables. The auxiliary cable support means, preferably a power driven winch, supports the auxiliary cable for movement with the main cable means during raising and lowering of the luminaire support.

The auxiliary assembly also includes means cooperating with the apparatus, either the main cable of the apparatus or the main drive means, for automatically and substantially immediately sensing the presence of a failure of the main drive means or the main cable to support the luminaire support and, in the event of such failure, for automatically providing a predetermined signal at substantially the moment of failure. In addition, the assembly includes cable movement affecting means, for example a power actuated break mechanism, cooperating with the auxiliary supporting arrangement for at least slowing down but preferably stopping movement of the auxiliary cable means in response to the predetermined failure indicating signal, whereby to at least slow down, again preferably stop, movement of the secondary cables to maintain the luminaire support in a cable supported position during the failure.

In a preferred embodiment, the auxiliary cable support means includes a power driven winch and the cable movement affecting means is comprised of a power actuated break mechanism, as previously stated. In this preferred embodiment, both of these components, i.e., the power driven winch and the power actuated break mechanism are powered by a common electrical source, for example the same electrical source that energizes the luminaires and powers the main drive. In response to the aforedescribed failure, the failure indicating signal disconnects the power to the auxiliary power driven winch and also to the break mechanism causing the latter to move to a breaking state from a non-breaking state for preventing movement of the auxiliary cable and therefore preventing movement of the luminaire support. Also in this preferred embodiment, the auxiliary assembly includes over-rule means which allows the auxiliary supporting arrangement in cooperation with the secondary cables to raise and lower the luminaire support independent of the main drive and main cable.

DETAILED DESCRIPTION AND PREFERRED EMBODIMENTS

Figure 1:
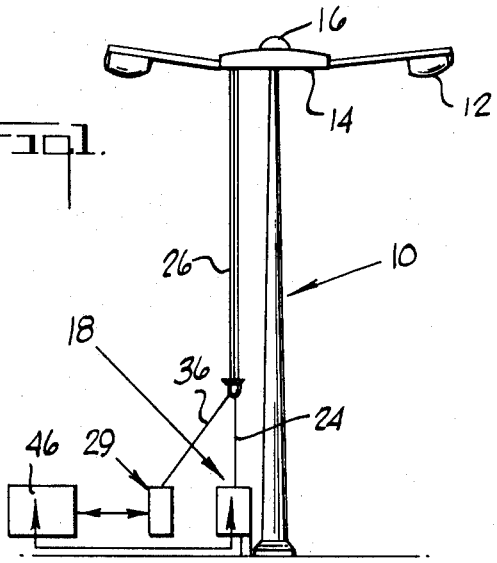
FIG. 1 is a schematic illustration, in elevation, of an apparatus for raising and lowering a luminaire support ring, including luminaires, along a luminaire support pole and an auxiliary assembly for use with this apparatus and constructed in accordance with the present invention.

Turning to the drawing, wherein like components are designated by like reference numerals throughout the various figures, attention is specifically directed to FIG. 1. This figure illustrates a luminaire pole 10 and luminaires 12, the luminaires being mounted to a suitable support ring 14 which in turn is held in place at the top of the pole by suitable means, for example a latching mechanism 16. The luminaire support 14 is one which is movable up and down pole 10 and is known in the art, for example see U.S. Pat. No. 3,847,333. The means 16 for holding the luminaire support in place at the top of the pole is also known in the art, see for example U.S. Pat. No. 3,721,816.

Figure 2:
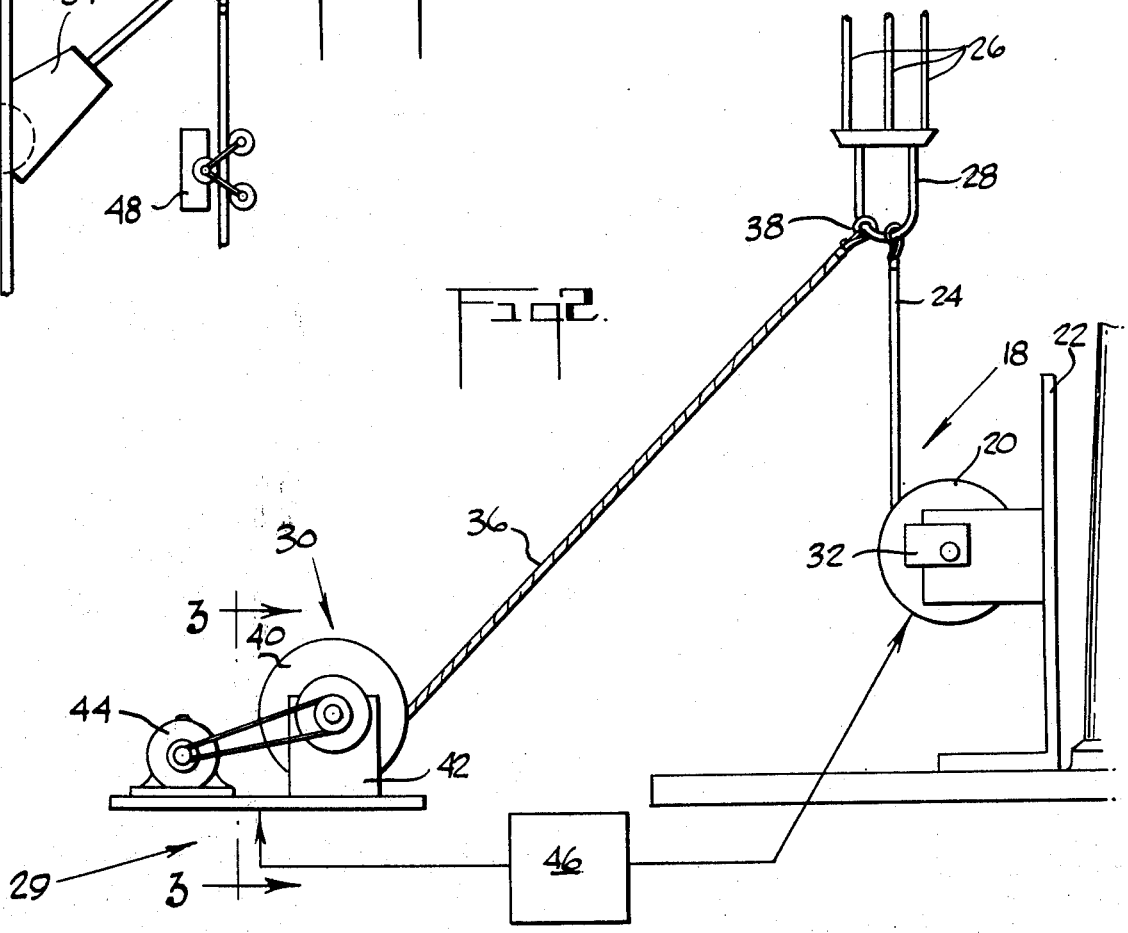
FIG. 2 is a schematic illustration showning some detailed structure of a portion of the apparatus and of the auxiliary assembly.

A system or apparatus, generally designated by the reference numeral 18, is also illustrated in FIG. 1 and is provided for raising the luminaire support ring 14 and luminaires 12 to the position shown in FIG. 1 and for lowering the support ring and luminaires to ground level. This system, as best seen in FIG. 2, includes a main power winch assembly 20 or other suitable drive means located at the base of pole 10 and held in place by suitable means 22. System 18 also includes a main cable 24 connected with the winch assembly 20 and a plurality of secondary cables 26 connected with the main cable and also connected with luminaire support ring 14. Suitable means, for example a hoisting cable transition clevis 28 is provided for connecting the secondary cables 26 to main cable 24. While not shown specifically, power winch assembly 20 includes an electrically driven motor for driving the winch. While this motor may be one which is maintained at the pole along with the winch at all times, it is preferably a portable motor carried by the individual maintaining the luminaires and readily connected to the winch. This motor may receive power from the source that energizes luminaires 12. Accordingly, an appropriate outlet (not shown) to connect this source to the motor may be provided at the base of pole 10 or otherwise suitably close to the base.

Having described system 18, it should be clear that this system is provided for raising luminaire support ring 14 and luminaires 12 from ground level to latching mechanism 16 at the top of the pole and for moving the support back to ground level. In this regard, suitable means (not shown) comprising part of latching mechanism 16 are provided for automatically locking the ring in place at the top of the pole and for unlocking the ring for movement down the pole. While not shown, the secondary cables 26 connected at opposite ends to transition clevis 28 and luminaire support ring 14 extend over a series of pulleys. Hence, as the luminaire support ring moves down the pole, the main cable 24, the transition clevis and that portion of the secondary cables between the transition clevis and the pulleys move up the pole. In addition, due to the weight of the support ring and luminaires connected therewith, during this movement, the main cable 24 and secondary cables 26 are held taut, i.e., in a state of tension, the degree of which will depend upon the weight of the luminaire support ring and luminaires.

In accordance with the present invention, an auxiliary assembly 29 is provided for supporting ring 14 and luminaires 12 in the event the winch assembly 20 and/or the main cable 24 fails to provide such support when the luminaire support is moving up or down pole 10 or is otherwise not locked in place at the top of the pole. This assembly includes an auxiliary supporting arrangement 30 for supporting the ring during such failure, a device 32 for sensing the presence of such a failure and for automatically providing a predetermined signal at the moment of failure, and a mechanism 34 (see FIG. 3) cooperating with supporting arrangement 30 for at least slowing down, preferably stopping, movement of secondary cables 26 in response to the failure indicating signal. This, in turn, at least slows down, preferably stops, downward movement of ring 14 and luminaires 12 due to the gravitational forces of the luminaire support ring and luminaires and thereby maintains the luminaire support and luminaires in a cable supported position.

The auxiliary supporting arrangement 30 includes an auxiliary takeup cable 36 which is connected to transition clevis 28 by suitable means 38, preferably means which can be readily connected to and disconnected from the transition clevis. Such means could be for example a hoisting hook with a safety latch. The auxiliary supporting arrangement also includes a power driven winch 40 supported by suitable support means 42 and driven by an electric motor 44 also supported by means 42. Electric motor 44 is preferably powered by the same source powering the motor comprising part of winch assembly 20, i.e., the source used to energize luminaries 12. In this regard, the auxiliary assembly preferably includes a control box 46. Suitable means are provided in the control box for connecting both winch motors therethrough and to the common electrical source. This control box may also include suitable means for turning on and off the motors, varying the speeds of the motors and other conventional control components to be discussed hereinafter.

Auxiliary supporting arrangement 30 also includes a cable tension maintaining device 49 for maintaining auxiliary cable 36 taut, i.e., in the state of tension as the cable moves up and down the luminaire pole with transition clevis 28, i.e., as the auxiliary cable is let out by winch 40 and as it is taken in by winch 40 during movement of luminaire support 14. A device of this type is well known in the art and will not be described in detail. It suffices to state that such a device can be, for example, a permanent magnet or electrically energized magnetic particle tension control unit or equivalent fluid type coupling. However, it should be sufficient to prevent excessive instantaneous G-forces on either the secondary cables 26 or the auxiliary cable in the event either the main cable 24 or the main winch assembly 20 fails to support the luminaire support ring and luminaires.

Figure 3:
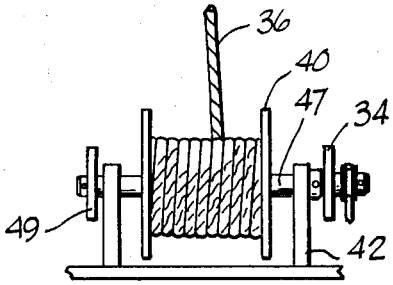
FIG. 3 is a schematic illustration of a portion of the assembly illustrated in FIGS. 1 and 2.

The tension maintaining device 49 just described is one which acts on winch 40 in fulfilling its intended purpose. By extending the drum 47 of winch 40, as illustrated in FIG. 3, this device can be positioned around the drum extension.

The device 32 used for sensing the presence of a failure of the winch assembly 20 or main cable 24 to support luminaire support 14 and for providing a predetermined signal may also be conventional. This device includes suitable means for monitoring the load condition in power winch assembly 20. Device 32 also includes a suitable means for providing the aforediscussed failure indicating signal under a no-load condition. In an alternative embodiment, instead of monitoring the load in winch assembly 20, a device 48, illustrated in FIG. 4, could be provided for monitoring directly the tension on main cable 24. In the event that the main cable fails to support luminaire support ring 14 or in the event the main winch assembly 20 fails to support the luminaire support, device 48 will be actuated and like device 32, it will provide the aforediscussed failure indicating signal.

Figure 4:
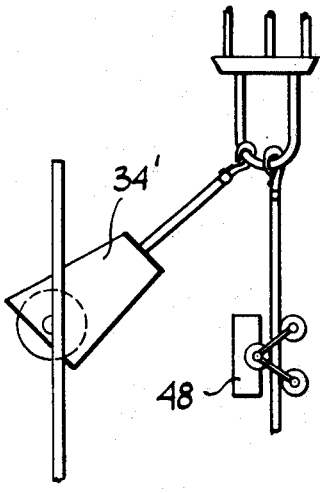
FIG. 4 is a schematic illustration of a modification of the assembly illustrated in FIGS. 1 and 2.

The cable movement affecting device 34, as stated previously, receives this signal for at least slowing down but preferably stopping movement of auxiliary cable 36 so as to support luminaire support ring 14 and luminaires 12. This device may be of any conventional type known in the art but is preferably an electrically actuated, electromagnetic break which when energized is in a non-breaking state for allowing free movement of the auxiliary cable and when deenergized is in a breaking state for at least slowing down movement of the auxiliary cable. As illustrated this breaking mechanism can act on the motor drum or as shown in FIG. 4, indicated at 34', a suitable breaking mechanism acting on cable 36 could be provided in lieu of mechanism 34. The failure indicating signal is preferably one which cuts power to this break mechanism. Hence, when device 32 or device 48 senses a failure, providing the failure indicating signal, this signal cuts off power to the break mechanism, deenergizing the latter and causing it to go into a breaking state. In the absence of such a signal, the break mechanism remains energized and therefore in a non-breaking state.

To accomplish the foregoing, any suitable means known in the art could be provided. For example, control box 46 could include an electromagnetic relay with for example, a normally open contact which would be provided in series with the electromagnetic break and the electrical source. So long as this relay remains energized, its normally open contact is closed so that the break mechanism is energized and in a non-breaking state. The device 32 or 48 can be connected with this relay so that upon sensing the presence of a failure in either the winch assembly 20 or the main cable 24, it automatically de-energizes the relay causing the closed contact to open and thereby de-energizing the break mechanism so that the latter goes into a breaking state.

In the preferred embodiment of the present invention, in the event of a failure indicating signal, power is also disconnected from both the main winch assembly and the motor 44 comprising part of arrangement 30. This can also be accomplished in a known manner. For example, the aforediscussed relay could include normally open contacts in series with the main winch assembly and motor 44 and the power going to the components. In response to the failure indicating signal, the relay de-energizes, as previously stated, causing these additional relay contacts to open and therefore disconnecting assembly 20 and motor 44 from their source of power.

In actual operation, arrangement 30 including winch 40, auxiliary cable 36 and motor 44 along with control box 46, the motor comprising part of assembly 20, sensing mechanism 32 (or 48) and cable movement affecting device 34 (for example the breaking mechanism) are portably brought to the site, i.e., to the luminaires to be maintained. The various components are connected together in the manner described with auxiliary cable 36 connected to transition clevis 28. Where load sensing device 32 is used it is preferably permanently connected with the winch assembly 20 and if device 48 is used, it is attached to the main cable 24 and adjusted to provide the failure indicating signal at the appropriate time.

The auxiliary winch and motor are connected with the main winch assembly so that whenever the main winch assembly is operating, either raising or lowering the luminaire support and luminaires, the drive motor 44 is also running, actually synchronized with the main winch motor. This can also be accomplished by any suitable means including for example by an electromagnetic relay. By means of tension device 34, an appropriate pull, for example a 100 lbs., is maintained on the auxiliary cable regardless of whether the luminaire support is moving up or down the pole or even if there is a differential in the two winch drum speeds.

If failure occurs or even if there is a slack in main cble 24 or secondary cables 26, device 32 (or 48) substantially immediately provides the aforediscussed signal cutting power to the break mechanism, the main winch assembly and motor 44, hence allowing the auxiliary cable to support the luminaire support via secondary cables 26. Arrangement 30 preferably includes an over ride system which allows the arrangement to either lower the luminaire support to ground level or raise it back to the top of a pole by its own power independent of main winch assembly 20. Hence, the luminaire can be lowered to the ground by means of arrangement 30 independent of winch assembly 20 so that the latter can be inspected or the luminaire support can be raised to the top of the pole by the arrangement 30 while inspection takes place.

What we claim is:

1. An auxiliary assembly for use with an apparatus which raises and lowers a luminaire support along a support pole and which supports said luminaire support during this movement, said apparatus including main drive means and main cable means connected with said drive means and with said support for movement with said support, said assembly comprising:

a. an auxiliary supporting arrangement including
   i. auxiliary cable means connected with said main cable means at a specific point between said luminaire support and said main drive means, said specific point separating said main cable means into an upper portion located between said support and point and a lower portion located between said point and said main drive means.
   ii. auxiliary cable support means supporting said auxiliary cable means for movement with said main cable means during the raising and lowering of said luminaire support, and
   iii. means for maintaining said auxiliary cable means taut;

b. means cooperating with said apparatus for automatically and substantially immediately sensing the presence of a failure of said main drive means or said lower portion of said main cable means to support said luminaire support and, in the event of such failure, for automatically providing a predetermined signal at substantially the moment of said failure; and c. cable movement affecting means cooperating with said auxiliary supporting arrangement for at least slowing down movement of said auxiliary cable means in response to said predetermined signal, whereby to at least slow down movement of said upper portion of said main cable means to maintain said luminaire support in a cable supported position during said failure.

2. An assembly according to claim 1 wherein said auxiliary cable support means includes auxiliary drive means for moving said auxiliary cable means so as to raise and lower said luminaire support along said pole during said failure, independent of said main drive means.

3. An assembly according to claim 1 wherein said auxiliary cable support means includes a power driven winch and means for driving said winch.

4. An assembly according to claim 1 wherein said sensing and signal producing means includes tension sensing means cooperating with said lower portion of said main cable means for sensing whether or not said lower portion is under tension and means for providing said signal in the event said lower portion is not under tension.

5. An assembly according to claim 1 wherin said sensing and signal producing means includes load sensing means cooperating with said main drive means of said apparatus for sensing whether or not there is a load on said drive means and means for providing said signal in the event there is no load on said main drive means.

6. An assembly according to claim 1 wherein said cable movement affecting means comprises a breaking mechanism for slowing down movement of said auxiliary cable means in response to said signal.

7. An assembly according to claim 6 wherein said breaking mechanism prevents movement of said auxiliary cable means in response to said signal, whereby to prevent movement of said upper cable portion and said luminaire support.

8. An assembly according to claim 1 wherein said auxiliary cable means is readily adapted for engagement with and disengagement from said main cable means and wherein said auxiliary supporting arrangement is portable.

9. An assembly according to claim 1 wherein said cable movement affecting means prevents movement of said auxiliary cable means in response to said predetermined signal, whereby to prevent movement of said upper cable portion.

10. An assembly according to claim 1 wherein said auxiliary support means includes electrically driven means for supporting said auxiliary cable means, wherein said auxiliary supporting arrangement includes an electrical source for powering said power driven means and wherein said cable movement affecting means includes a. an electrically driven break mechanism which when energized is in a non-breaking state for allowing free movement of said auxiliary cable means and when de-energized is in a breaking state for at least slowing down movement of said auxiliary cable means, and b. means connected with said breaking mechanism, said sensing means and said electrical source for connecting said source to said break mechanism to energize the latter in the absense of said predetermined signal and for disconnecting said breaking mechanism from said source to de-energize said mechanism in response to said signal.

11. An auxiliary assembly for use with an apparatus which raises and lowers a luminaire support along a support pole and which supports said luminaire support during this movement, said apparatus including an electrically powered main winch, an electrical source for powering the winch, a first main cable connected with said main winch, a plurality of second main cables connected with said luminaire support and cable connecting means connecting said first cable with said second cables between said winch and said support, said main winch being adapted to move said first cable and second cables for raising and lowering said luminaire support, said assembly comprising:

a. a portable supporting arrangement including i. an auxiliary cable connected with said cable connecting means including means for readily connecting said auxiliary cable with and disconnecting it from said cable connecting means, ii. an electrically powered auxiliary winch supporting said auxiliary cable for movement with said main cables during the raising and lowering of said luminaire support, iii. means for maintaining said auxiliary cable means taut, and iv. said electrical source for powering said auxiliary winch;

b. means cooperating with said apparatus for automatically and substantially immediately sensing the presence of a failure of said main winch or said first main cable to support said luminaire support and, in the event of such failure, for automatically providing a predetermined signal at substantially the moment of said failure; and c. cable movement affecting means cooperating with said portable supporting arrangement for at least slowing down the movement of said auxiliary cable in response to said predetermined signal, whereby to at least slow down the movement of said second main cables to maintain said luminaire support in a cable supported position during said failure.

12. An assembly according to claim 11 wherein said cable movement affecting means prevents movement of said auxiliary cable in response to said predetermined signal, whereby to prevent said second main cables from moving and therefore to prevent said support from moving.

13. An assembly according to claim 12 wherein said cable movement affecting means includes a. an electrically driven break mechanism which when energized is in a non-breaking state for allowing free movement of said auxiliary cable and when de-energized is in a breaking state for preventing movement of said auxiliary cable, and b. means connected with said breaking mechanism, said sensing means and said electrical source for connecting said source to said break mechanism to energize the latter in the absence of said predetermined signal and for disconnecting said breaking mechanism from said source to de-energize said mechanism in response to said signal.

14. An assembly according to claim 12 including means connected with said main winch, said sensing means, and said electrical source for connecting said source to said main winch in the absence of said signal and for disconnecting said main winch from said source in response to said signal.

* * * * *